US007140337B2

(12) United States Patent
Tsuji

(10) Patent No.: US 7,140,337 B2
(45) Date of Patent: Nov. 28, 2006

(54) VALVE GEAR MECHANISM

(75) Inventor: Kimitoshi Tsuji, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/992,682

(22) Filed: Nov. 22, 2004

(65) Prior Publication Data

US 2005/0115531 A1 Jun. 2, 2005

(30) Foreign Application Priority Data

Dec. 1, 2003 (JP) ..... 2003-401695

(51) Int. Cl.
*F01L 3/10* (2006.01)

(52) U.S. Cl. ..... 123/90.65; 123/90.66; 123/90.47; 123/188.12; 123/188.17; 251/85; 251/262; 251/263; 251/337; 267/216; 267/248; 267/251

(58) Field of Classification Search ..... 123/90.65, 123/90.66, 188.17; 251/337
See application file for complete search history.

(56) References Cited

U.S. PATENT DOCUMENTS 1,182,632 A * 5/1916 Bruegger ..... 123/90.65
2,117,434 A * 5/1938 Krebs ..... 123/188.1
2,225,265 A * 12/1940 Fitts ..... 123/90.47
2,707,945 A * 5/1955 Hughes ..... 123/90.47
3,995,605 A * 12/1976 Yew ..... 123/286
5,692,462 A * 12/1997 Hackett ..... 123/42

FOREIGN PATENT DOCUMENTS

JP 59-068509 A 4/1984
JP 8-177536 7/1996

* cited by examiner

*Primary Examiner*—Thai-Ba Trieu
*Assistant Examiner*—Kyle M. Riddle
(74) *Attorney, Agent, or Firm*—Oliff & Berridge, PLC

(57) ABSTRACT

In a valve gear mechanism of an internal combustion engine, there is provided a valve opening and closing a combustion chamber, a spring device which generates a force pressing the valve toward a valve seat, a drive mechanism driving the valve in an opening direction via an operating section capable of being in contact with and separated from the valve, and a separation inhibiting device which inhibits a separation between the operating section and the valve.

7 Claims, 4 Drawing Sheets

VALVE GEAR MECHANISM

BACKGROUND OF THE INVENTION

The present invention relates to a valve gear mechanism of an intake valve or an exhaust valve of an internal combustion engine.

DESCRIPTION OF THE RELATED ART

There has been known a valve gear mechanism which opens and closes an intake valve of an internal combustion engine through a cam driven by an actuator (refer to Japanese Patent Application Laid-Open (JP-A) No. 8-177536). In addition, JP-A No. 59-68509 exists as a prior technical document relevant to the present invention.

Each of the intake valve and the exhaust valve of the conventional internal combustion engine is pressed against a valve seat by a valve spring. When a spring constant of the valve spring is small, when the valve is opened and closed at a high speed at the time of, for example, a high rotating operation of the internal combustion or the like, there is a possibility that the intake and exhaust valves are opened due to a reaction of a collision between the intake and exhaust valves and the valve seat. Further, when an engine deposit such as a phosphor or the like bites into a portion between the valve and the valve seat, there is a possibility that the valve is forced to be opened. Accordingly, a spring constant is set in the valve spring so as to have such a strength that the intake and exhaust valves can be inhibited from being opened (abnormally opened) due to the reaction of the collision when the valve is opened and closed at a high speed, the bite of the deposit or the like. The setting of the spring constant mentioned above increases a load applied to a drive source driving the intake and exhaust valves in the opening direction, and deteriorates a specific fuel consumption of the internal combustion engine.

SUMMARY OF THE INVENTION

Accordingly, an object of the present invention is to provide a valve gear mechanism of an internal combustion engine which can reduce a load applied to a drive source driving intake or exhaust valve in an opening direction, and can inhibit an abnormal valve opening in which the intake or exhaust valve is opened based on a reaction of a collision between the valve and a valve seat when the valve is opened and closed.

In order to achieve the object mentioned above, according to one aspect of the present invention, there is provided a valve gear mechanism of an internal combustion engine comprising: a valve opening and closing a combustion chamber; a spring device which generates a force pressing the valve toward a valve seat; a drive mechanism driving the valve in an opening direction via an operating section capable of being in contact with and separated from the valve; and a separation inhibiting device which inhibits a separation between the operating section and the valve.

When the valve is driven in the opening direction by the drive mechanism (at the time of a normal valve opening), since the force of the drive mechanism is transmitted to the valve via the operating section, the operating section and the valve are in contact with each other and are integrally operated. Accordingly, the separation inhibiting device is not operated. On the other hand, since the spring device generates the force pressing the valve toward the valve seat, repulsion force driving the valve in the closing direction is generated in the spring device when the valve is driven in the opening direction by the drive mechanism. Therefore, the valve is driven in the closing direction only by the repulsion force generated in the spring device.

On the other hand, at the time of the abnormal valve opening, the valve is directly driven in the opening direction based on the reaction or the like generated at the time when the valve is collided with the valve seat. When the valve is directly driven in the opening direction as mentioned above, the valve is going to move in the opening direction, however, the operating section is hardly moved in the opening direction. In this case, the operating section and the valve are going to be separated from each other, so that the separation inhibiting device is operated. Further, since the valve is driven in the opening direction, the spring device generates the repulsion force. Accordingly, the repulsion force of the spring device and the separation inhibiting force generated by the separation inhibiting device are applied to the valve, and the valve is driven in the closing direction by both forces.

As explained above, according to the valve gear mechanism of the internal combustion engine based on the present invention, since the valve can be driven in the closing direction by the spring device and the separation inhibiting device when the operating section and the valve are separated from each other, it is not necessary to inhibit the abnormal valve opening only by the spring device. Accordingly, it is possible to set a spring constant smaller than a spring constant which can inhibit even the abnormal valve opening, to the spring device. Further, since it is sufficient that the drive mechanism drives the valve in the opening direction against only the spring device, it is possible to lower the load of the drive mechanism.

In a preferred embodiment of the present invention, the separation inhibiting device may employ various devices as far as it is possible to inhibit the operating section and the valve from being separated from each other. For example, as the separation inhibiting device, there may be provided with an inhibiting spring device installed from the operating section to the valve. As described above, it is possible to inhibit the separation by arranging the spring so as to be installed from the operating section to the valve and attracting the operating section and the valve to each other. Further, a permanent magnet may be attached to a contact portion between the operating section and the valve, thereby inhibiting the operating section and the valve from being separated from each other by a magnetic force thereof. In this case, it is not necessary to attach the permanent magnet to both of the operating section and the valve. The permanent magnet may be attached to one of them and a magnetic substance may be attached to the other, as far as the magnetic force can be applied between the operating section and the valve so as to inhibit the separation thereof.

When the drive mechanism is provided with a rocker arm, the rocker arm may serve as the operating section. Since only the valve is driven in the opening direction when the valve is opened due to the reaction at the time of the abnormal valve opening, the valve and the rocker arm are separated from each other. Accordingly, a separation inhibiting force is generated in the separation inhibiting device provided between the rocker arm and the valve. Therefore, the valve can be driven in the closing direction by the spring device and the separation inhibiting device, at the time of the abnormal valve opening.

According to another aspect of the present invention, there is provided a valve gear mechanism of an internal combustion engine comprising: a valve opening and closing a combustion chamber; spring means for generating a force pressing the valve toward a valve seat; a drive mechanism driving the valve in an opening direction via an operating section capable of being in contact with and separated from the valve; and separation inhibiting means for inhibiting a separation between the operating section and the valve.

DESCRIPTION OF THE PREFERRED EMBODIMENTS

Figure 1B:
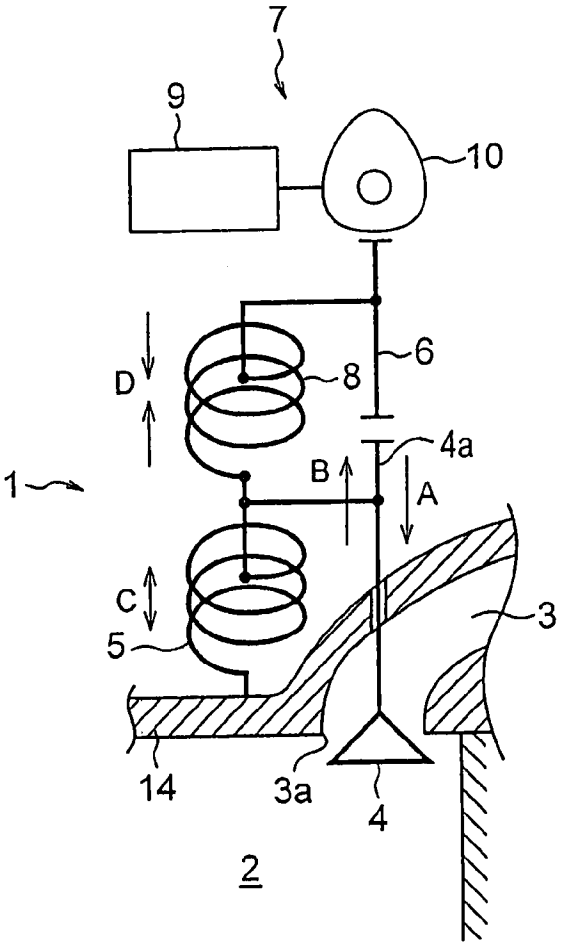
FIGS. 1A and 1B are views showing a valve gear mechanism of an internal combustion engine according to an embodiment of the present invention.
Figure 1A:
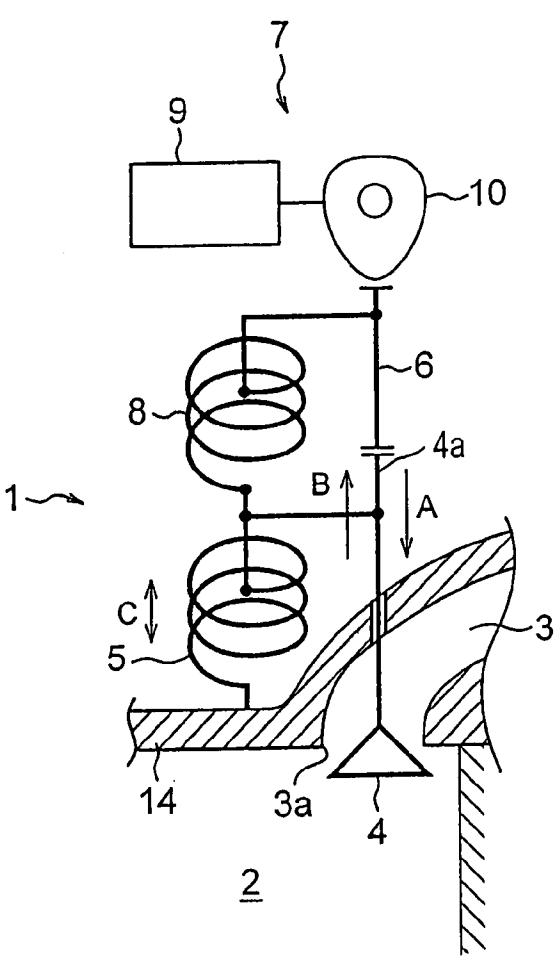

FIGS. 1A and 1B show a valve gear mechanism of an internal combustion engine according to an embodiment of the present invention. As shown in FIG. 1A, a valve gear mechanism 1 is provided with an intake valve (hereinafter, it maybe abbreviated as a valve) 4 for opening and closing a combustion chamber 2 with respect to an intake passage 3, a first spring 5 generating a force for pressing the valve 4 against a valve seat 3*a* (a force in a direction of an arrow B in FIGS. 1A and 1B), a drive mechanism 7 driving the valve 4 in an opening direction (a direction of an arrow A in FIGS. 1A and 1B) via an intermediate stem 6 serving as an operating section, and a second spring 8 installed between the intermediate stem 6 and the valve 4 in such a manner that one end thereof is fixed to the valve 4, while the other end thereof is fixed to the intermediate stem 6. The first spring 5 is disposed between a stem 4*a* of the valve 4 and a cylinder head 14 so as to energize the valve 4 upward by its repulsion force. The second spring 8 generates an energizing force pressing the valve 4 and the intermediate stem 6 against each other, thereby serving as a separation inhibiting device and an inhibiting spring device. The drive mechanism 7 is provided with an electric motor 9 serving as a drive source, and a cam 10 attached to an output shaft of the electric motor 9 and transmitting a rotating motion of the motor 9 to the intermediate stem 6. Namely, the cam 10 is rotated by the motor 9 and its rotation is converted into a liner motion of the intermediate stem 6 in its axial direction. The intermediate stem 6 is disposed coaxially with the stem 4*a* of the valve 4 and is movable in its axial direction by being guided through appropriate guide means (not shown). The upper end of the intermediate stem 6 is capable of being in contact with and separated from the outer peripheral surface of the cam 10, while the lower end thereof is capable of being in contact with and of being separated from the upper end of the valve stem 4*a*.

Next, a motion of the valve gear mechanism 1 mentioned above is explained.

As shown in FIG. 1A, when the cam 10 drives the intake valve 4 in the opening direction (the direction of the arrow A), the cam 10 pushes down the intake valve 4 in the direction of the arrow A via the intermediate stem 6. In this case, since the first spring 5 is compressed based on a movement of the intake valve 4 in the direction of the arrow A, a repulsion force (a force in a direction of an arrow C in FIGS. 1A and 1B) is generated in the first spring 5. The repulsion force of the first spring 5 is obtained as $K_1X$ by multiplying a spring constant $K_1$ of the first spring 5 by a displacement X of the intake valve 4 in the direction of the arrow A. In this case, since the intermediate stem 6 and the intake valve 4 are integrally displaced in the valve opening direction in a state in which the intermediate stem 6 and the intake valve 4 are brought into contact with each other, the second spring 8 is displaced in the valve opening direction together with the intermediate stem 6 and the intake valve 4 without being relatively displaced in both ends thereof. In other words, when the intake valve 4 is opened by the cam 10, the second spring 8 is neither expanded nor contracted. Accordingly, the intake valve 4 is driven in the direction of the arrow B only by the repulsion force (the force in the direction of the arrow C in FIGS. 1A and 1B) of the first spring 5.

On the other hand, as shown in FIG. 1B, when the valve 4 cannot be pressed against the valve seat 3*a* only by the first spring 5 due to a high speed opening and closing motion of the valve 4 and the valve 4 is abnormally opened, only the intake valve 4 is moved in the direction of the arrow A, and the intermediate stem 6 is hardly moved. In this case, since the intake valve 4 and the intermediate stem 6 are separated from each other, the second spring 8 is pulled in a vertical direction. Accordingly, a repulsion force (a force in a direction of an arrow D in FIG. 1B) is generated in the second spring 8. The repulsion force of the second spring 8 is obtained as $K_2X$ by multiplying a spring constant $K_2$ of the second spring 8 by the displacement X of the intake valve 4 in the direction of the arrow A. Further, since the first spring 5 is compressed based on the movement of the intake valve 4 in the direction of the arrow A, the repulsion force ($K_1X$) is also generated in the first spring 5. Accordingly, the intake valve 4 is driven in the direction of the arrow B by a force $(K_1+K_2)X$ obtained by summing up the repulsion force (the force in the direction of the arrow C in FIGS. 1A and 1B) of the first spring 5 and the repulsion force (the force in the direction of the arrow D in FIGS. 1A and 1B) of the second spring 8.

In this case, for example, it is possible to set such a value that the valve 4 can be prevented from being opened due to the reaction of the collision between the intake valve 4 and the valve seat 3*a* at the time of the normal operation of the internal combustion engine in which the valve gear mechanism 1 is installed, to the spring constant $K_1$ of the first spring. For example, it is possible to set such a value that the intake valve 4 can be prevented from being moved in the opening direction based on the addition to the spring constant $K_1$ of the first spring at the time of the abnormal valve opening, to the spring constant $K_2$ of the second spring.

Figure 2A:
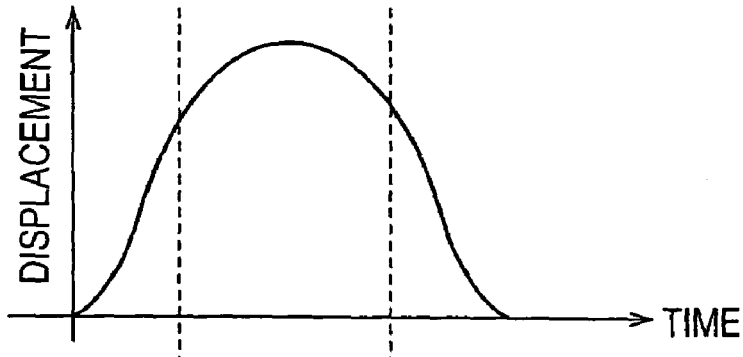
FIGS. 2A to 2D are views showing an example of the time change of a displacement, a speed, an acceleration and a reaction force of an intake valve in an opening direction.
Figure 2B:
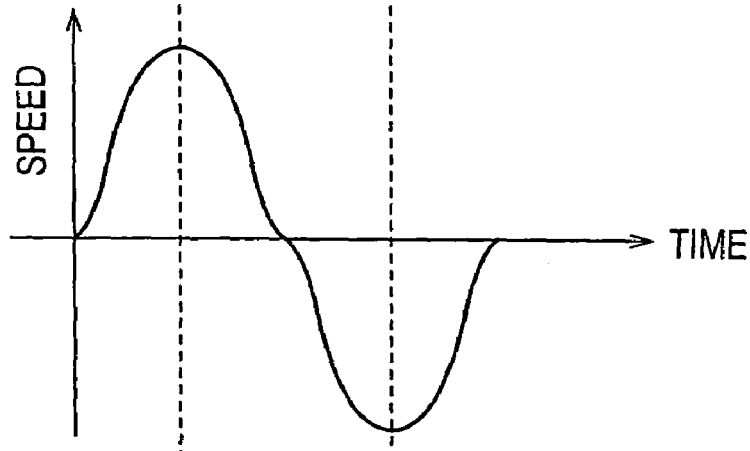
Figure 2C:
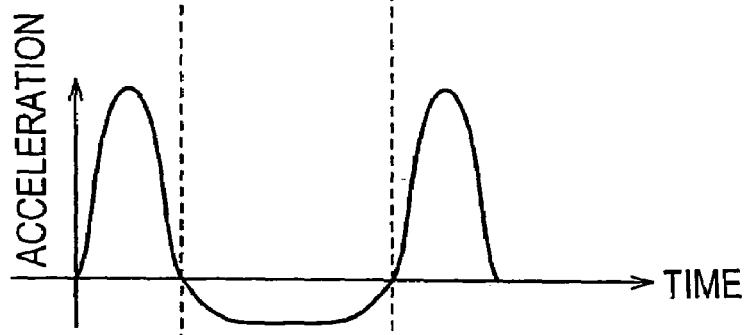
Figure 2D:
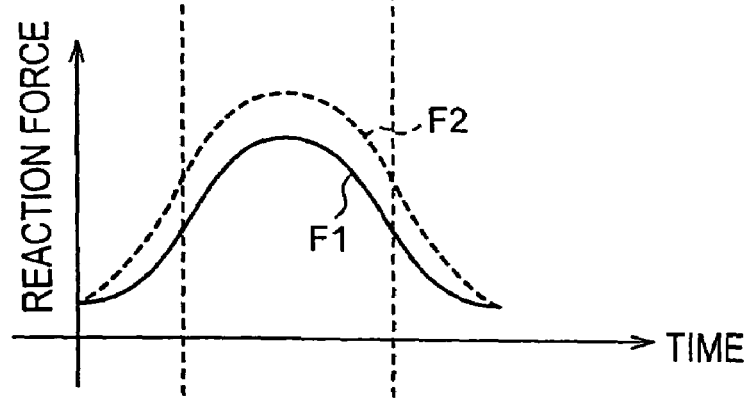
Figure 3:
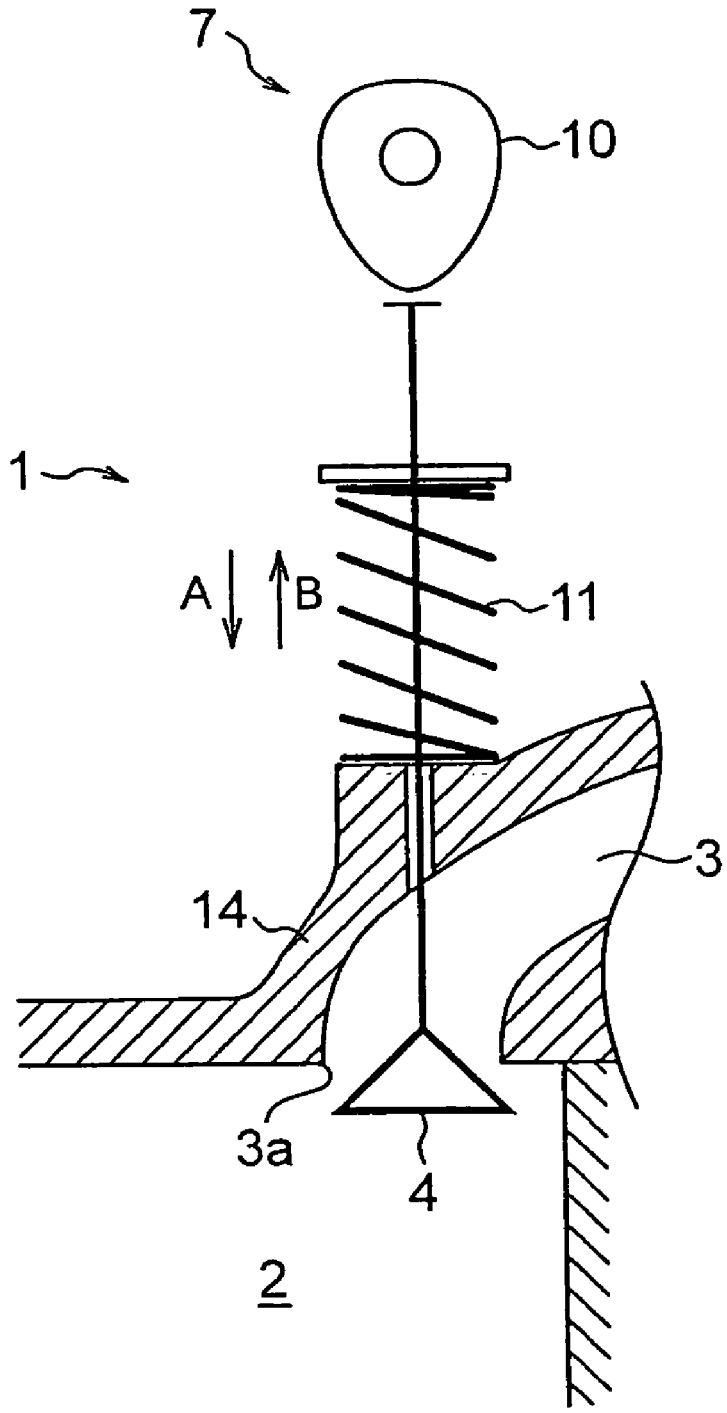
FIG. 3 is a view showing a valve gear mechanism pressing the intake valve against a valve seat by one valve spring.

FIGS. 2A to 2D show an example of the time change of a displacement, a speed, an acceleration and a reaction force (the repulsion force of the first spring 5) of the intake valve 4 in the direction of the arrow A when the intake valve 4 is driven by the drive mechanism 7. A solid line F1 in FIG. 2D shows the time change of a reaction force applied to the intake valve 4 according to the embodiment in FIGS. 1A and 1B. A dotted line F2 in FIG. 2D shows the time change of a reaction force applied to the intake valve 4 in a comparative example shown in FIG. 3. In the comparative example in FIG. 3, the intake valve 4 is pressed against the valve seat 3*a* by one valve spring 11. Accordingly, the spring constant $(K_1+K_2)$ is set in the valve spring 11 so as to inhibit the abnormal valve opening due to the reaction of the collision between the intake valve 4 and the valve seat 3*a* or the like. In FIG. 3, the same reference numerals are attached to the common portions to those in FIGS. 1A and 1B.

As is apparent from FIG. 2D, since it is sufficient to open the intake valve 4 against only the repulsion force $K_1X$ of the first spring 5 in the embodiment in FIGS. 1A and 1B, it is possible to lower the force $K_2X$ by which the drive mechanism 7 drives the intake valve 4 in the opening direction by a degree of $K_2X$ in comparison with the comparative example in FIG. 3.

As mentioned above, according to the present embodiment, since the intake valve 4 is driven in the closing direction by the first spring 5 and the second spring 8 when the intake valve 4 is forced to abnormally be opened, it is not necessary to inhibit the abnormal valve opening only by the first spring 5. Accordingly, it is possible to set the spring constant smaller than the spring constant by which the abnormal valve opening can be inhibited, to the first spring 5. Further, since the first spring 5 and the second spring 8 drive the intake valve 4 in the closing direction together, at the time of the abnormal valve opening when the intermediate stem 6 and the intake valve 4 are separated from each other, it is possible to inhibit the abnormal valve opening of the valve 4.

Figure 4B:
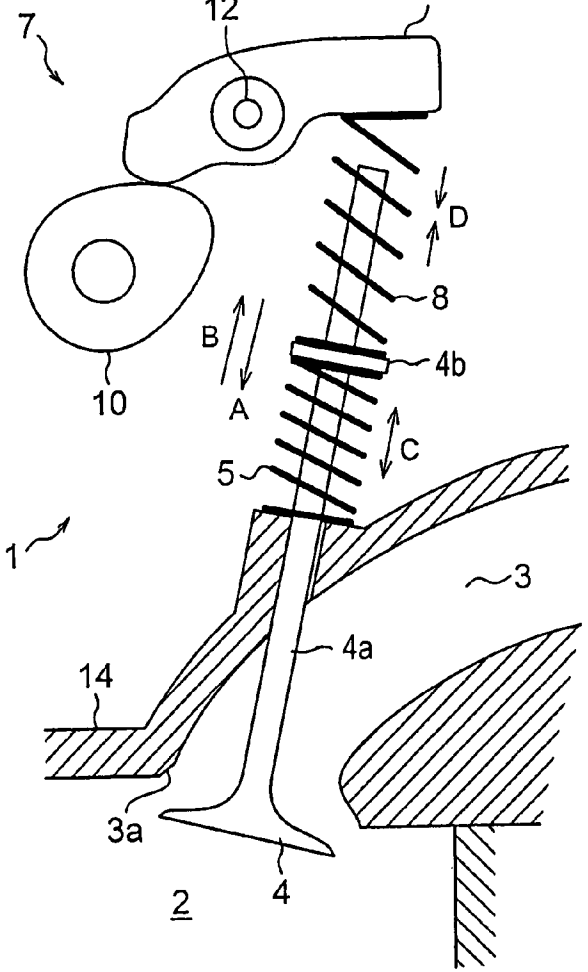
FIGS. 4A and 4B are views showing another embodiment of the valve gear mechanism according to the present invention.
Figure 4A:
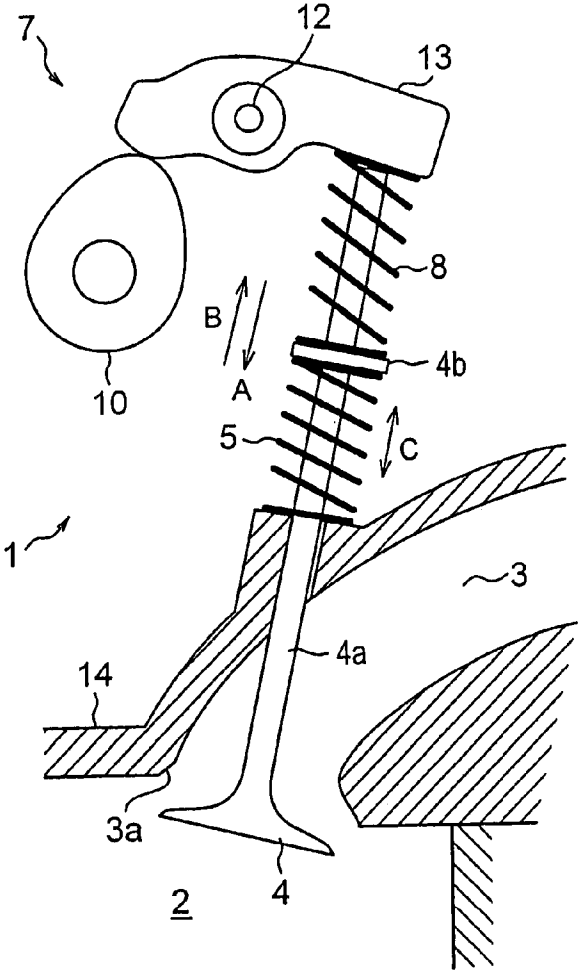

FIG. 4 shows another embodiment of the valve gear mechanism according to the present invention. In this case, in FIG. 4, the same reference numerals are attached to the common portions to those in FIGS. 1A and 1B. The drive mechanism 7 in the valve gear mechanism 1 in FIG. 4 drives the intake valve 4 in the opening direction via a rocker arm 13 provided so as to freely swing around a pivot shaft 12 and serving as the operating section. The intake valve 4 is provided with a mounting plate 4*b* for mounting the second spring 8. The mounting plate 4*b* is fixed to the midway portion of the stem 4*a* so as to be movable together with the stem 4*a* of the valve 4. As shown in FIG. 4A, the first spring 5 is arranged around the stem 4*a* and is provided between the mounting plate 4*b* and the cylinder head 14 of the internal combustion engine on which the valve gear mechanism 1 is mounted. Further, the second spring 8 is also arranged around the stem 4*a* and is connected to the rocker arm 13 at one end while connected to the mounting plate 4*b* at the other end, respectively, thereby being arranged so as to be installed between the intake valve 4 and the rocker arm 13. In other words, both ends of the second spring 8 are fixed to the mounting plate 4 and the rocker arm 13, respectively, thereby allowing the second spring 8 to be displaced in the opening direction together with the rocker arm 13 and the valve 4 and to be stretched when the rocker arm 13 moves away from the upper end of the stem 4*a*.

FIG. 4A shows a state of the normal valve opening time when the intake valve 4 is driven in the opening direction by the drive mechanism 7. In this case, since the rocker arm 13 and the intake valve 4 are integrally operated while being in contact with each other, no repulsion force is generated in the second spring 8. On the other hand, since the first spring 5 is compressed based on the movement of the intake valve 4 in the opening direction, only a repulsion force (a force in a direction C in FIG. 4) of the first spring 5 is applied to the intake valve 4.

On the other hand, as shown in FIG. 4B, when the intake valve 4 is forced to be opened based on the abnormal valve opening, the intake valve 4 and the rocker arm 13 are separated from each other. Accordingly, a repulsion force (a force in a direction of an arrow D in FIG. 4B) is generated in the second spring 8. Therefore, the repulsion forces of the first spring 5 and the second spring 8 are applied to the intake valve 4. In this case, in a direct-push type valve gear system, it is possible to apply a valve lifter as the operating section according to the present invention in place of the rocker arm.

The present invention is not limited to the embodiments mentioned above, but maybe executed according to various aspects. For example, the valve gear mechanism according to the present invention may be applied to the exhaust valve. Further, the drive source of the cam driving the valve in the opening direction is not limited to the electric motor, but the structure is such that the cam is driven by transmitting the power from the output shaft of the internal combustion engine in which the valve gear mechanism according to the present invention is installed.

As is described above, according to the present invention, the valve is driven in the closing direction only by the spring device at the time of the normal valve opening by the drive mechanism, and the valve is driven in the closing direction by both of the spring device and the separation inhibiting device at the time of the abnormal valve opening. Accordingly, it is possible to set the spring constant of the spring device smaller than that of the conventional valve gear mechanism. Therefore, it is possible to inhibit the abnormal valve opening as well as it is possible to lower the load applied to the drive mechanism at the time of the normal valve opening. Further, it is possible to improve an energy efficiency of the internal combustion engine by lowering the load applied to the drive mechanism, and it is possible to improve a fuel consumption.

What is claimed is:

1. A valve gear mechanism of an internal combustion engine, comprising:

a valve opening and closing a combustion chamber;

a spring device which generates a force pressing the valve toward a valve seat;

a drive mechanism driving the valve in an opening direction via an operating section that selectively is in contact with and separated from the valve; and a separation inhibiting device which generates an attractive operation between the operating section and the valve to inhibit a separation between the operating section and the valve, one end of the separation inhibiting device being fixed to a stem of the valve and another end of the separation inhibiting device being fixed to the operating section to generate a force against a pulling operation to be acted on the separation inhibiting device, thereby generating the attractive operation between the operating section and the valve.

2. The valve gear mechanism of the internal combustion engine according to claim 1, wherein the separation inhibiting device is provided with an inhibiting spring device installed from the operating section to the valve.

3. The valve gear mechanism of the internal combustion engine according to claim 2, wherein an intermediate stem serving as the operating section is provided between the valve and the drive mechanism so as to be arranged coaxially with the stem of the valve and be movable in an axial direction thereof, the drive mechanism is arranged so as to drive the valve in the opening direction together with the intermediate stem, and the inhibiting spring device is provided in such a manner that one end thereof is fixed to the stem of the valve while another end thereof is fixed to the intermediate stem, thereby being displaced in the opening direction together with the intermediate stem and the valve.

4. The valve gear mechanism of the internal combustion engine according to claim 3, wherein the spring device has a spring constant by which the valve can be prevented from being opened due to a reaction of a collision between the valve and the valve seat at a time of a normal operation of the internal combustion engine in which the valve gear mechanism is installed, and the inhibiting spring device has a spring constant by which the valve can be prevented from being moved in the opening direction based on an addition to the spring constant of the spring device at a time of an abnormal valve opening.

5. The valve gear mechanism according to claim 2, wherein a midway portion of the stem of the valve is provided with a mounting plate movable together with the stem of the valve, the spring device is provided between the mounting plate and a cylinder head on which the valve gear mechanism is mounted, the drive mechanism is provided with a rocker arm serving as the operating section and pivotable around a pivot shaft so as to be in contact with and separated from the valve, and the inhibiting spring device is arranged around the stem of the valve in such a manner that one end thereof is fixed to the mounting plate while another end thereof is fixed to the rocker arm, thereby being displaced in the opening direction together with the rocker arm and the valve.

6. The valve gear mechanism of the internal combustion engine according to claim 5, wherein the spring device has a spring constant by which the valve can be prevented from being opened due to a reaction of a collision between the valve and the valve seat at a time of a normal operation of the internal combustion engine in which the valve gear mechanism is installed, and the inhibiting spring device has a spring constant by which the valve can be prevented from being moved in the opening direction based on an addition to the spring constant of the spring device at a time of an abnormal valve opening.

7. A valve gear mechanism of an internal combustion engine, comprising:

a valve opening and closing a combustion chamber;

spring means for generating a force pressing the valve toward a valve seat;

a drive mechanism driving the valve in an opening direction via an operating section that selectively is in contact with and separated from the valve; and separation inhibiting means for generating an attractive operation between the operating section and the valve to inhibit a separation between the operating section and the valve, one end of the separation inhibiting means being fixed to a stem of the valve and another end of the separation inhibiting means being fixed to the operating section to generate a force against a pulling operation to be acted on the separation inhibiting means, thereby generating the attractive operation between the operating section and the valve.

* * * * *